United States Patent [19]

Schwartz

[11] 4,038,777

[45] Aug. 2, 1977

[54] AIRBORNE, HOVERING, DECORATIVE OBJECT, TOY OR THE LIKE

[75] Inventor: Seymour S. Schwartz, Los Angeles, Calif.

[73] Assignee: Gambit Enterprises, Beverly Hills, Calif.

[21] Appl. No.: 655,087

[22] Filed: Feb. 4, 1976

[51] Int. Cl.[2] ..... A63H 27/10

[52] U.S. Cl. ..... 46/87; 244/30

[58] Field of Search ..... 40/106.21; 46/87, 88, 46/89, 90; 117/46; 244/30, 33

[56] References Cited

U.S. PATENT DOCUMENTS

| | | | |
|---|---|---|---|
| 2,487,546 | 11/1949 | Harrowe | 46/88 |
| 3,462,289 | 8/1969 | Rohl et al. | 117/46 |
| 3,591,975 | 5/1971 | Tere | 46/87 |
| 3,820,744 | 6/1974 | Denton | 244/30 |

*Primary Examiner*—Louis G. Mancene
*Assistant Examiner*—Robert F. Cutting
*Attorney, Agent, or Firm*—Martin R. Horn

[57] ABSTRACT

A gas filled, balloon-like object capable of defining a non-spherical shape, such as a lenticular shape, suitable as a decorative object for home use or the like. A high modulus graphite-impregnated epoxy material is used to prevent distortion of the inflated object.

9 Claims, 6 Drawing Figures

AIRBORNE, HOVERING, DECORATIVE OBJECT, TOY OR THE LIKE

BACKGROUND OF THE INVENTION

1. Field of the Invention

The invention relates to the field of airborne, hovering, lighter-than-air objects, particularly those having a non-spherical shape.

2. Prior Art

Hot air balloons and helium or hydrogen filled balloons and dirigibles have been known and used for many years for such purposes as entertainment, observation and transportation. The overall principles of physics which govern the flight of such objects have been known for centuries. Balloons used both as toys or for other purposes have often been made from a very thin, light film, such as rubber, paper, etc., and then filled with a lighter-than-air gas or hot air. Usually the shape of the balloon was spherical or nearly spherical and as more gas was added to the balloon, the balloon tended to become more spherical. The reasons for this are that the sphere offers the most efficient shape, that is, it provides the greatest volume for the least surface area, and secondly, because the thin film naturally tends to become spherical as pressure is increased.

In the prior art in lighter-than-air balloons, particularly toy balloons, it has been impossible to fabricate balloons other than those having generally continuously curved shapes. Well-defined corners or edges formed by intersecting plane surfaces or many other esthetic shapes are not practical because they require a supporting frame to maintain the thin film or "skin" in the desired shape. The weight of such frames, even when the most efficient materials for such purposes are selected, requires a displaced volume of such size that fabrication for home use or the like is impractical. Moreover, the problem caused by the weight of the frame is compounded by the fact that the non-spherical shapes are less efficient as lighter-than-air objects since they require more surface material to define a given volume, than does a spherical shape.

The present invention provides a solution to this prior art problem by utilizing a frame fabricated from an epoxy-impregnated graphite fiber material having an extremely high modulus, thus resulting in a much higher strength-to-weight ratio than any other practical rigid material.

SUMMARY OF THE INVENTION

An airborne, hovering, decorative object, toy or the like capable of having a non-spherical shape, such as a lenticular shape, is disclosed. The object includes a frame fabricated from epoxy resin impregnated graphite fibers. A cover or skin is preformed and disposed about the frame. The cover may be fabricated from a polyethylene terephthalate or other thin film, relatively non-permeable material. The object is filled with helium gas and includes a valve to allow refilling. In one embodiment a gondola in which weights may be placed is disposed beneath the object in order that proper ballast may be added to cause the object to hover. In another embodiment a string having a linear or non-linear weight distribution along its length extends from the object onto the floor to compensate for loss of gas from the object, temperature change and changes in barometric pressure.

It is an object of the present invention to provide a small, lighter-than-air decorative object or toy which may have a generally non-spherical shape, and which can be made to hover at any given height, without being "tethered" in the usual sense.

DETAILED DESCRIPTION OF THE INVENTION

The present invention describes a lighter-than-air decorative object, toy or the like (hereinafter referred to simply as a decorative object) particularly suitable for use within a room since the size of the decorative object may be relatively small.

Figure 1:
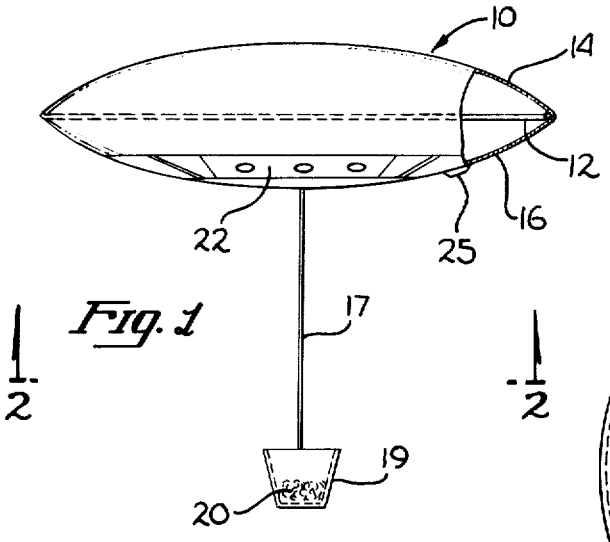
FIG. 1 is a side view, partially cut away, of one embodiment of the present invention illustrating a lenticular or saucer shaped object and a gondola.
Figure 2:
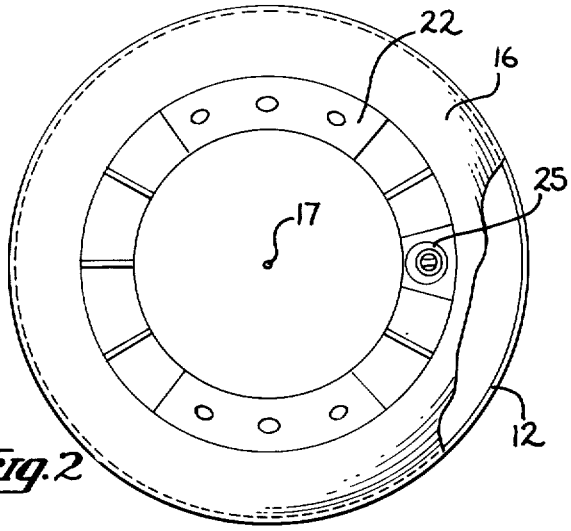
FIG. 2 is a view of the object of FIG. 1 taken along section line 2—2 of FIG. 1.

Referring to FIGS. 1 and 2, a first presently preferred embodiment of the invention is illustrated which includes a lighter-than-air decorative object 10 having a lenticular or "flying saucer" shape. The object 10 includes an internal structural ring 12 disposed at the seam defined by the upper skin or cover 14 and the lower skin or cover 16. The structural ring 12 is fabricated from epoxy impregnated graphite fibers. This material has a tensile modulus of as high as 35 million psi and a specific gravity of approximately 1.7, the material by way of example has a density modulus ratio of approximately 3 times that of high tensile steel.

The skin or covers for the object 10 are preformed to the appropriate shape so that a minimum amount of internal pressurization is required to maintain the desired shape. The skin or cover material comprises a material having low gas permeability so that a minimum amount of gas leaks from the object. The following materials have been found to be suitable for use as a skin or covering material since they may be readily formed into the desired shape, are relatively light weight and provide an excellent means for containing helium gas.

1. Polyethylene terephthalate (sold under the trademark "Mylar");
2. A laminate of polyethylene and vinylidene chloride (sold under the trademark "Saranex"); and,
3. A laminate of polyethylene terephthalate and aluminum foil.

The circular seam defined at the junction of the upper cover 14 and lower cover 16 is joined or sealed with tape, such as heat sealing tape, or sealed with ultrasonic vibration. Other known sealing techniques may be utilized.

Figure 3:
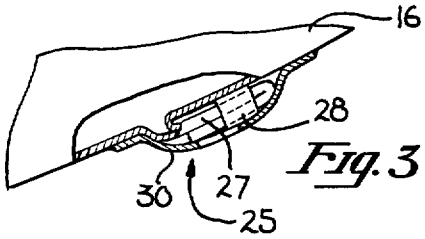
FIG. 3 is a cross-sectional, exploded view of a section of the object of FIG. 1 used to illustrate a valve.

The saucer 10 is filled through a valve 25 which may be any one of numerous valves commonly utilized in toys, particularly those which are light in weight. One such valve is illustrated in FIG. 3. It includes an elongated stem 27 which communicates with the interior of the object 10, that is, the volume defined by the upper cover 14 and lower cover 16. After the saucer 10 has been filled the stem is urged towards the cover 16, causing it to become pinched, and thereby preventing gas from escaping from the object 10. The stem 27 may then be tucked into a pocket 30 disposed on the exterior surface of the cover 16. The pocket 30 may be fabricated from the same material as the cover 16 or other light weight material may be utilized, such as paper. A band 28 may also be disposed about the stem 27 to prevent the escape of gas from the interior of the object 10.

The object 10 illustrated in FIGS. 1 and 2 has been fabricated wherein the ring 10 is approximately 24 inches in diameter, the upper skin 14 having a radius of approximately 30 inches and the lower skin 16 having a radius of approximately 48 inches. This results in an asymetrical configuration more esthetically pleasing. The ring weighs approximately 5 grams while the cover material or skin weighs approximately 18 grams. An object of this size displaces 30 grams or more of air, and is filled with helium to a pressure approximately equal to ambient pressure. By way of example, if a steel ring of stiffness equal to the epoxy-graphite ring were utilized in order to maintain the lenticular shape of the object 10 the smallest size which would lift itself would have to be approximately 4 feet in diameter, assuming the same relative shape. This size would be impractical if the object 10 is to be utilized within a home as a decorative object.

The object 10 is filled from a relatively low pressure source of helium which, in the presently preferred embodiment, is contained within a pressurized can resembling a typical aerosol can. Ideally, the object 10 should be filled just sufficiently to maintain the desired shape (with no additional pressure) in order to achieve the greatest lifting force although this is not possible without sophisticated equipment. In practice the stem 27 is fitted onto the stem of the source of gas and the object 10 is inflated with as little gas as appears necessary to achieve the desired shape. As might be expected, helium from the source of gas leaks into the atmosphere because of the inefficient coupling provided between the stem 27 and the source of gas. This, however, is an advantage since it prevents over-inflation of the object.

The object 10 illustrated in FIG. 1 also includes a gondola 19 coupled to the lower cover 16 by a string 17. The gondola 19 may be fabricated from any light weight material such as paper. After the saucer 10 has been filled, weights 20 are placed into the gondola in order to height stabilize the hovering characteristics of the "flying saucer". By a process of trial and error, that is, by placing different weights, or a different quantity of weights, within the gondola 19, the saucer may be readily made to hover. Markings 22 may be painted onto the object such as is illustrated in FIG. 1.

Figure 4:
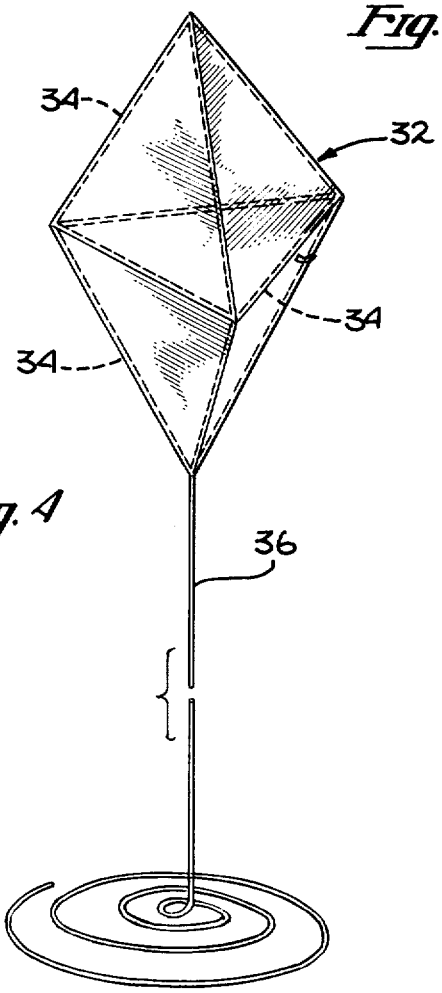
FIG. 4 illustrates another embodiment of the present invention wherein a hexahedral shaped object is illustrated.

In FIG. 4 an alternate embodiment of an airborne, floating object is illustrated as hexahedron 32. The hexahedron is constructed in a similar manner to the saucer 10 of FIG. 1 and includes a frame 34 fabricated from epoxy impregnated graphite. It is possible to construct hexahedron 32 wherein each of the six isosceles triangles defining the hexahedron have a base as small as approximately 24 inches and legs as small as approximately 21 inches. Other solids such as the so-called "Platonic solids" may be fabricated in sizes suitable for home use. The esthetically appealing "Platonic solids" are particularly decorative with skins fabricated from a material which includes an aluminum layer, since the aluminum reflects and diffuses incident light and since the object is generally in constant motion due to air currents within a room.

One means for controlling the height of the hovering object, such as the hexahedron 32, is illustrated in FIG. 4 as string 36. One end of string 36 is attached to the airborne object while the other end is in a coil or spiral disposed on the ground or floor beneath the object. A string arranged in this manner tends to compensate for loss of gas from the object, temperature changes and/or barometric changes. Assume that the hexahedron 32 is unstable and is rising. This may be caused by any one of numerous conditions, such as change in the temperature, change of barometric pressure or because the object has just been filled and is not height stable. As the hexahedron 32 rises, more string is lifted from the floor, automatically adding weight to the hexahedron 32. When sufficient weight is added, i.e., as sufficient string is lifted from the floor, the hexahedron 32 becomes height stabilized. In a similar manner, as the hexahedron because of an instability moves towards the floor, the amount of string supported by the hexahedron 32 is lessened, and hence the weight upon the hexahedron 32 is diminished. This causes the hexahedron to stabilize when sufficient string (weight) is lost.

Figure 5:
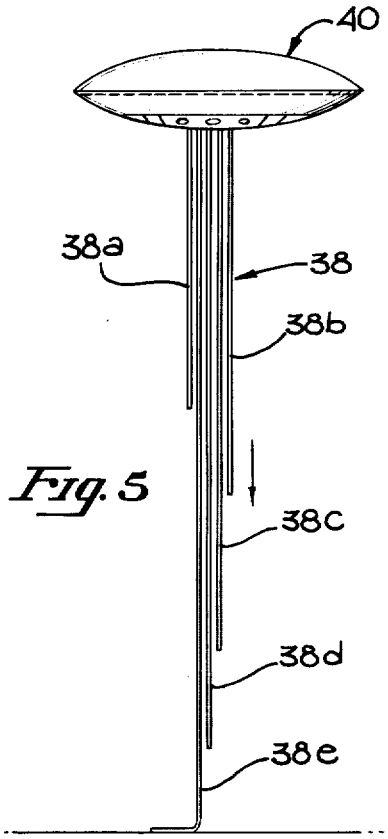
FIG. 5 illustrates a lenticular shaped object and a control means used for regulating the height at which the object hovers.

In FIG. 5 a saucer 40 is illustrated which may be identical with object 10 illustrated in FIGS. 1 and 2. A stabilizing means which functions in a similar manner to the string 36 of FIG. 4, is illustrated which comprises a string having a non-linear weight distribution along its length. One method for obtaining the non-linear weight distribution of the string 38 of FIG. 5 is to fabricate the string 38 from a plurality of strings of varying length as illustrated in FIG. 5. For example, string **38*a* is shorter than string 38*b*, string 38*b* is shorter than string 38*c*, string 38*c* is shorter than string 38*d*, and string 38*d* is shorter than string 38*e*. Note that strings 38*a*, 38*b*, 38*c*, 38*d* and 38*e* may each have uniform weight distribution along their lengths. As may be appreciated as the saucer 40** tends to move towards the floor, the weight it must support is lost more quickly the closer it becomes to the floor. This and other "non-linear" strings may be used to provide unusual stabilizing effects.

Thus, a relatively small, decorative, lighter-than-air object has been disclosed which may be fabricated in non-spherical shapes, including shapes which contain well defined corners and angled surfaces.

I claim:

1. A lighter-than-air decorative object having a general lenticular shape comprising:

an epoxy impregnated graphite ring;

a generally curved upper skin;

a generally curved lower skin, said upper skin material and said lower skin defining a seam disposed along said rings, and said upper skin and said lower skin defining a volume for containing gas; and, a valve for communicating with said volume for allowing a gas to be placed within said volume;

whereby a generally "flying saucer" shaped lighter-than-air decorative object of relatively small size is realizable.

2. The decorative object defined in claim 1 including an elongated string disposed from said object and extending onto a surface above which said object is hovering.

3. The decorative object defined in claim 2 wherein the weight distribution along said string is non-linear.

4. A lighter than air decorative object comprising:

a frame;

a skin material disposed about said frame defining a volume;

valve means for controlling the injection of gas into said volume;

control means for stabilizing the hovering characteristics of said decorative object;

whereby said decorative object may be made to hover.

5. The decorative object defined in claim 4 wherein said height stabilizing control means comprises an elongated string extending from said decorative object onto a surface above which said object is hovering.

6. The decorative object defined in claim 5 wherein the weight distribution along said string is non-linear.

7. The decorative object defined in claim 6 wherein said string includes a plurality of strings of different lengths.

8. The decorative object defined in claim 4 wherein said frame comprises an epoxy-resin impregnated graphite fiber member.

9. The decorative object defined in claim 5 wherein said frame comprises an epoxy-resin impregnated graphite member.

* * * * *